US009434512B2

(12) United States Patent
Branyon

(10) Patent No.: US 9,434,512 B2
(45) Date of Patent: Sep. 6, 2016

(54) HANDLE FOR USE WITH A FLEXIBLE PACKAGE

(71) Applicant: Sonoco Development, Inc., Hartsville, SC (US)

(72) Inventor: Jacob Branyon, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 14/309,140

(22) Filed: Jun. 19, 2014

(65) Prior Publication Data

US 2015/0367993 A1 Dec. 24, 2015

(51) Int. Cl.
*B65D 25/10* (2006.01)
*B65D 33/06* (2006.01)

(52) U.S. Cl.
CPC ..... *B65D 33/06* (2013.01)

(58) Field of Classification Search
CPC ..... B65D 75/56; B65D 33/06
USPC ..... 220/759, 752; 383/6
See application file for complete search history.

(56) References Cited

U.S. PATENT DOCUMENTS 2,236,681 A * 4/1941 Goldschmidt ..... 206/411
2,654,475 A * 10/1953 Carpenter ..... B65D 5/46024 206/163
2,773,635 A * 12/1956 Stelzer ..... 206/390
3,333,308 A 8/1967 Mack
3,416,720 A * 12/1968 Kleinhaut ..... 383/26
3,801,012 A * 4/1974 Thelen ..... 229/117.22
4,339,070 A * 7/1982 Davies ..... B65D 5/723 229/117.24
4,387,846 A 6/1983 DuCorday
4,691,369 A * 9/1987 Costa ..... 383/17
4,816,014 A * 3/1989 Bratton ..... B31B 1/90 271/184
4,850,718 A * 7/1989 Gotou et al. ..... 383/20
6,233,786 B1 5/2001 Lin
7,670,050 B2 * 3/2010 Haimerl et al. ..... 383/28
8,231,029 B2 7/2012 Peer et al.
2008/0037907 A1 * 2/2008 Suskind ..... 383/2
2008/0080794 A1 * 4/2008 Kruse ..... B31B 19/86 383/14
2009/0106942 A1 * 4/2009 Dell'Orfano ..... 16/425
2009/0255946 A1 * 10/2009 Rose et al. ..... 220/754
2011/0033133 A1 * 2/2011 Kujat ..... 383/20
2012/0145733 A1 6/2012 Heilman
2013/0129260 A1 * 5/2013 Pellingra et al. ..... 383/12

* cited by examiner

*Primary Examiner* — Nathan J Newhouse
*Assistant Examiner* — Derek Battisti
(74) *Attorney, Agent, or Firm* — Miller, Matthias & Hull LLP

(57) ABSTRACT

A track and handle assembly for use with a flexible package is provided. The rigid box-like track has a top wall defining an elongated slot. The track may be recessed within an opening in the package wall. The handle assembly comprises a flexible handle and moveable guide members captured within the track and biased away from each other by the resiliently flexible handle. The handle assembly is moveable between a first position in which the handle is flat and a second position in which the handle is arc shaped.

8 Claims, 1 Drawing Sheet

HANDLE FOR USE WITH A FLEXIBLE PACKAGE

BACKGROUND OF THE INVENTION

1. Field of the Invention

This invention patent relates to a handle for use with a flexible package. More particularly, this invention relates to a low-profile, rigid track and handle assembly for use with a flexible package.

2. Description of the Related Art

Carrying large or heavy flexible packages can be a challenge for consumers. Some bags have large, integrated die-cut handles, but these bags require additional material and can result in additional scrap during the manufacturing process. The present invention is intended to solve these problems.

BRIEF SUMMARY OF THE INVENTION

The present invention is a rigid track and a handle assembly for use with a flexible package. The track has a top wall defining an elongated slot and may be recessed within an opening in the package wall. The handle assembly comprises a flexible handle and moveable guide members captured within the track and biased away from each other by the handle. The handle assembly is moveable between a first position in which the handle is flat and a second position in which the handle is arc shaped.

DETAILED DESCRIPTION OF THE INVENTION

Figure 1:
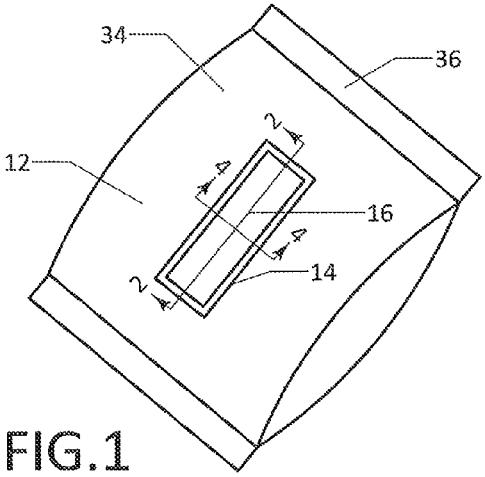
FIG. 1 is a perspective view of a flexible bag having a handle assembly according to the present disclosure.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Turning to the drawings, there is shown in FIG. 1 one embodiment of the present disclosure, a container 10 comprising a flexible package 12, an elongated track 14 affixed to the package 12 and a handle assembly 16.

The flexible package 12 may be of the type having a flexible front panel and flexible rear panel affixed along top and bottom seams. The track 14 may be affixed to front panel as shown. Preferably the track 14 and handle assembly 16 are low-profile, that is, they are recessed below the plane of the front panel and/or designed to have a minimum height, allowing for less material and minimizing any impact on shelf space, pallet loads and truck loading.

Figure 4:
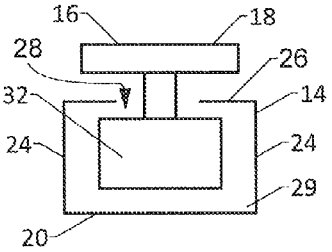
FIG. 4 is a cross-sectional view of the handle assembly of FIG. 1 taken along line 4-4.
Figure 2:
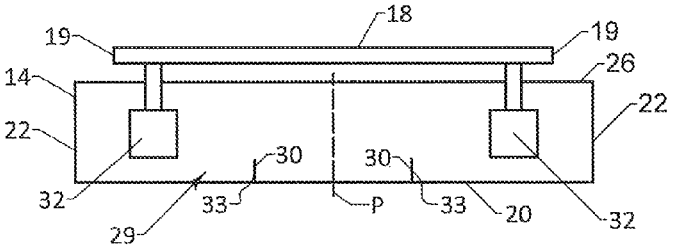
FIG. 2 is a cross-sectional view of the handle assembly of FIG. 1 taken along line 2-2.
Figure 3:
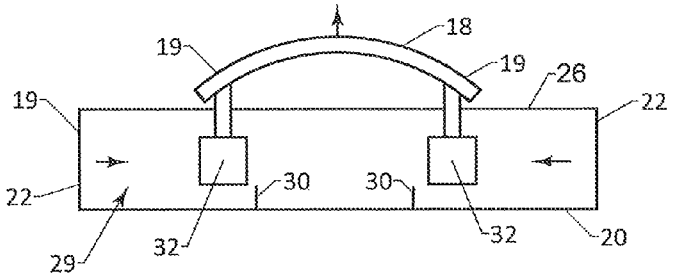
FIG. 3 is a cross-sectional view of the handle assembly of FIG. 2 showing the handle in a raised position.

As best shown in FIGS. 2-4, the track 14 has a bottom wall 20, end walls 22 extending upward from the bottom wall 20, side walls 24 extending upward from the bottom wall 20 and a top wall 26 extending between the side walls 24 and the end walls 22. The top wall 26 defines an elongated slot 28. The track 14 defines an interior 29 and further comprises a pair of spaced apart stops 30 located within the interior 29 and configured to limit the inward movement of a pair of guide members 32. Preferably the stops 30 have outwardly facing stop surfaces 33 spaced equally from a center plane P of the track 14.

The handle assembly 16 comprises a resiliently flexible handle 18 having opposing ends 19 and moveable guide members 32 located within the track interior 29 and attached to the handle 18 near the opposing ends 19. The guide members 32 are biased away from each other and toward their respective end walls 22 by the handle 18 and move inwardly toward each other when the handle 18 is lifted by a user. The handle 18 remains affixed to the track 14 while being lifted because the guide members 32 are larger than the slot 28 and cannot be removed from the track 14 without destroying the integrity of the track 14.

The track 14 may be affixed to the flexible package 12 in any suitable location and in any suitable manner. In FIG. 4 the track 14 is affixed to a front panel 34 of the package 12 and may be recessed within an opening in the front panel 34. The track 14 and handle assembly 16 can lay flat when not in use, but the handle 18 forms an arc when pulled on and used to carry the package 12. The track 14 can be adhered to the package 12 using any suitable adhesive or by heat sealing.

Figure 5:
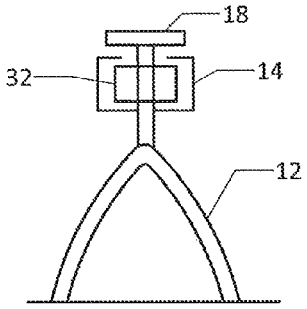
FIG. 5 is a cross-sectional view of a handle assembly according to the present disclosure affixed to a package seam.

In FIG. 5 the track 14 is affixed to a top seam 36 by, for example, mechanical means. This may be accomplished by integrating teeth or male/female features in the track 14 to allow it to grip or lock onto the end seam 36.

The track 14 and the handle assembly 16 are separate pieces or constructions. The track 14 is affixed to the flexible package and the handle assembly 16 floats free of the package 12 but is tethered to the track 14 by the guide members 32 as explained above.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. An easy to carry container comprising:

a flexible package having a first flexible panel and a second flexible panel affixed to each other along at least one seam;

a separate elongated rigid track adhered to the first flexible panel, the track having a rigid bottom wall, rigid side walls extending upward from the bottom wall and a rigid top wall extending between the side walls, the top wall defining an elongated slot, the top wall, bottom wall and side walls defining a track interior, the track further comprising a pair of spaced apart stops located within the track interior and configured to limit the inward movement of a pair of guide members;

a resiliently flexible handle having opposing ends, the handle being located outside the track interior; and the moveable guide members attached to the opposing ends, each moveable guide member captured within the track interior and configured to slide reciprocally within the track interior, the guide members being biased away from each other by the handle and configured to move inwardly toward each other until they abut one of the stops when the handle is lifted by a user.

2. The container of claim 1 wherein:

the track is affixed to a flexible front panel of the package.

3. The container of claim 2 wherein:

the front panel defines a plane and the track is recessed within an opening in the front panel so that the track extends below the plane of the front panel.

4. The container of claim 3 wherein:

the handle is moveable between a first position in which the handle is flat and a second position in which the handle is arc shaped.

5. The container of claim 4 wherein:

the track is adhered to the package using an adhesive.

6. The container of claim 4 wherein:

the track is adhered to the package by heat sealing.

7. An easy to carry container comprising:

a flexible package having a first flexible panel and a second flexible panel affixed to each other along at least one seam;

a separate elongated rigid track, the track having a rigid bottom wall, rigid side walls extending upward from the bottom wall and a rigid top wall extending between the side walls, the top wall defining an elongated slot, the top wall, bottom wall and side walls defining a track interior, the track further comprising a pair of spaced apart stops located within the track interior and configured to limit the inward movement of a pair of guide members;

a resiliently flexible handle having opposing ends, the handle being located outside the track interior; and the moveable guide members attached to the opposing ends, each moveable guide member captured within the track interior and configured to slide reciprocally within the track interior, the guide members being biased away from each other by the handle and configured to move inwardly toward each other until they abut one of the stops when the handle is lifted by a user, wherein:

the track is affixed to a seam of the flexible package.

8. The container of claim 1 wherein:

the track is affixed to the flexible package and the handle floats free of the package but is tethered to the track by the guide members.

* * * * *